US007431139B2

(12) United States Patent
Streibig et al.

(10) Patent No.: US 7,431,139 B2
(45) Date of Patent: Oct. 7, 2008

(54) ESCALATOR GUIDE SYSTEM

(75) Inventors: Kurt Streibig, Rekawinkel (AU); Thomas Novacek, Schwechat (AU); Thomas Illedits, Neufeld (AU)

(73) Assignee: Inventio AG, Hergiswil (CH)

( * ) Notice: Subject to any disclaimer, the term of this patent is extended or adjusted under 35 U.S.C. 154(b) by 78 days.

(21) Appl. No.: 11/497,904

(22) Filed: Aug. 2, 2006

(65) Prior Publication Data

US 2007/0029161 A1 Feb. 8, 2007

(30) Foreign Application Priority Data

Aug. 4, 2005 (EP) ..... 05107204

(51) Int. Cl.
*B66B 23/14* (2006.01)

(52) U.S. Cl. ..... 198/327; 198/326

(58) Field of Classification Search ..... 198/326, 198/327

See application file for complete search history.

(56) References Cited

U.S. PATENT DOCUMENTS 4,569,433 A * 2/1986 Ishida et al. ..... 198/333
5,325,955 A * 7/1994 Ahls et al. ..... 198/332
2001/0023811 A1* 9/2001 Ulrich ..... 198/326
2004/0134749 A1* 7/2004 Lunacek et al. ..... 198/326
2006/0151286 A1* 7/2006 Streibig et al. ..... 198/326

FOREIGN PATENT DOCUMENTS

DE 10300587 A1 * 7/2004

* cited by examiner

*Primary Examiner*—Mark A Deuble
(74) *Attorney, Agent, or Firm*—Schweitzer Cornman Gross & Bondell LLP

(57) ABSTRACT

A compactly constructed guide system has a run surface for guiding the run of the chain rollers. To guide the sides of the steps, a sliding pin arranged on a step rests on a side surface. A counter-surface serves as a counter-guide for the chain rollers and prevents the chain links from being pushed together. By means of an encapsulation, the step rollers, the chain links, and the running surface can be protected from dirt, dust, water, objects, etc. For run guidance of the step roller, a running surface is provided. An oil collecting channel prevents dripping of lubricating oil. The guide system rests on a bracket plate projection and is releasably connected to the bracket plate. The single-piece guide system is simple and efficient to install and can be accurately positioned at the sides against stops.

10 Claims, 3 Drawing Sheets

ESCALATOR GUIDE SYSTEM

The invention relates to a guide system for step rollers and chain rollers of steps of an escalator and a method of installing the guide system, there being provided a single-piece section with areas for guiding the run of the rollers in different planes and with areas for fastening the section onto parts of the truss.

BACKGROUND OF THE INVENTION

From patent application DE 103 00 587 A1 a guide system for step/pallet rollers and chain rollers of steps/pallets of an escalator or moving walk respectively has become known. The guide system is formed by a single-piece section with acceptance areas provided in different planes for simultaneous acceptance of the step/pallet rollers and chain rollers.

While such a device allows a device relative to known devices brings, at best, a simplification of the fastening of the guide system to the support truss, it does not provide adequate protection for the rollers.

It is accordingly an object of the present invention to avoid disadvantages of the known device and create a multifunctional guide system for step rollers and chain rollers as well as a method of installing the guide system.

BRIEF DESCRIPTION OF THE INVENTION

The inventive guide system comprises a single-piece section that is configured Into areas in different planes for guiding the step and chain rollers and with an area for fastening the section to the truss. Additional sections are further provided to protect the rollers and to counter-guide the rollers.

Besides guiding the run of the rollers, the invention advantageously provides for guidance of the sides of the steps on the lower guide rail, a counter-guidance of the chain rollers, splashing-water or all-weather encapsulation, an oil-groove channel or oil-cup channel or oil collecting-cup channel, and a fastening support or fastening accepter and fastening spacer accepter for the support or fastening of the guide system. Despite the multifarious functions of the constructionally simple guide system, installation is greatly simplified. Thanks to simple fastening by means of screws or clips, the guide system can be installed without difficulty and in a short time. The guide system can be precisely manufactured from an endless strip of steel plate, and close tolerances maintained, by cold forming with rollers.

With the guide system according to the invention, the distance between the lower and the upper guide rail can be reduced, allowing a bracket plate support, and the truss of the escalator, to be constructed more compactly.

Thanks to the uncomplicated, simple installation procedure of the guide system according to the invention, valuable worktime can be saved. Through its being single-piece and having few fastening parts, its manufacture and production are very economical.

BRIEF DESCRIPTION OF THE DRAWINGS

The present invention is described in more detail in the following description of an illustrative embodiment in association with the annexed; figures, wherein.

DETAILED DESCRIPTION OF THE INVENTION

Figure 1:
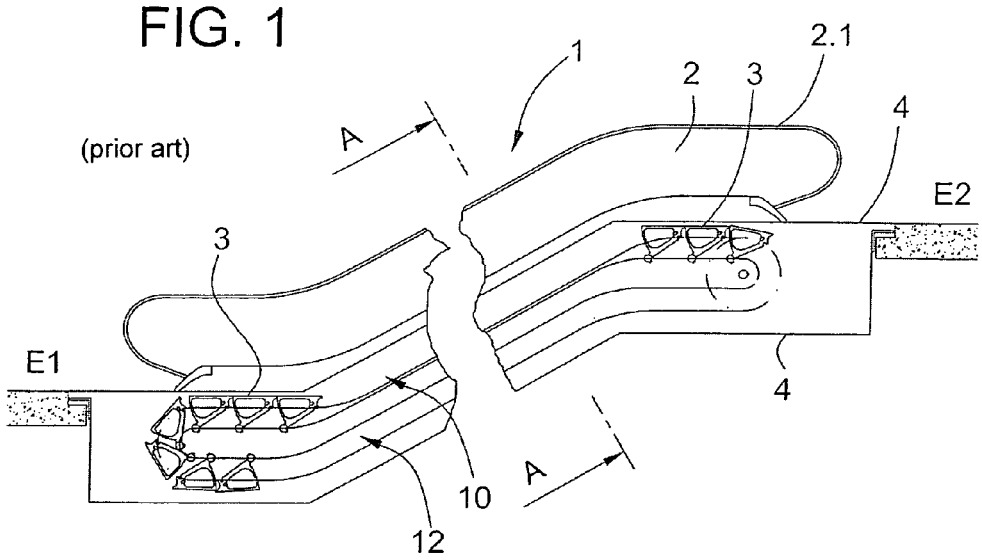
FIG. 1 is a diagrammatic representation of an escalator with a balustrade and step band with which the present invention is employed.

FIG. 1 shows an escalator 1 with a glass balustrade 2 with handrail 2.1 and steps 3 that form an endless step band. Running in the transporting direction, the steps 3 transport people and objects and, after reversal, return in the opposite direction with the step surfaces facing down.

The escalator 1 connects a lower story E1 with an upper story E2, a truss 4 serving as support for the step band and the balustrade 2. The steps 3 are guided in the transporting direction by means of a guide system 10 and in the return direction by means of a guide system 12.

Figure 2:
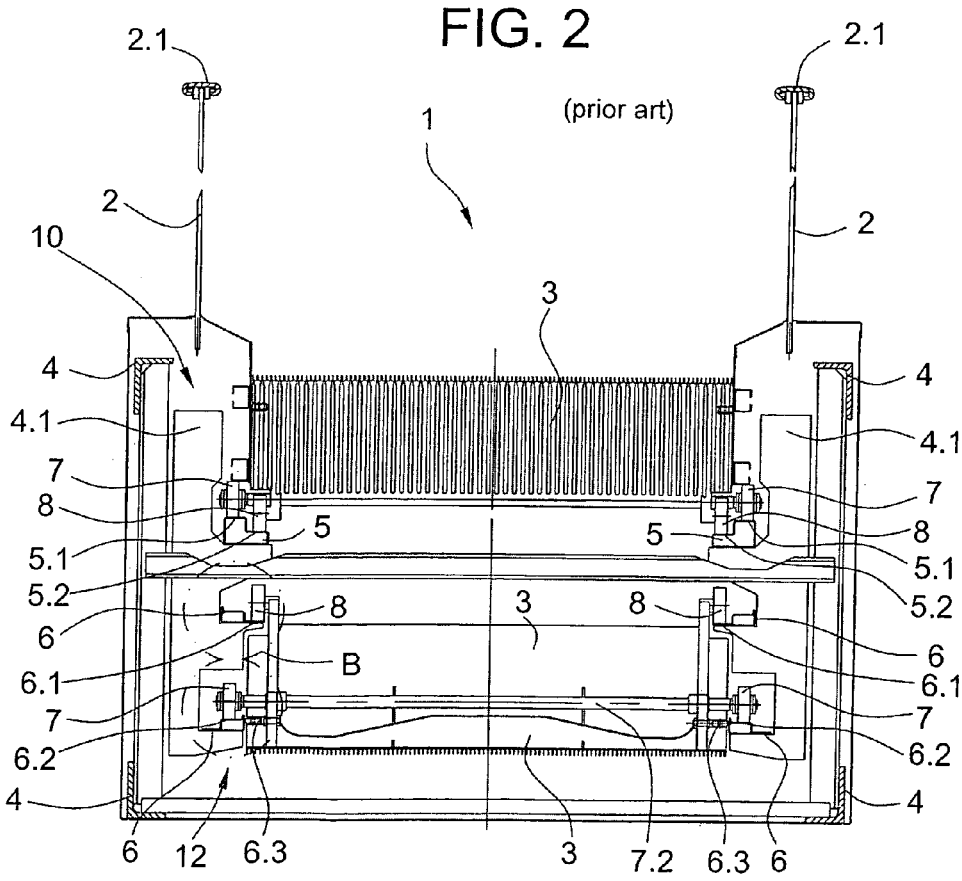
FIG. 2 is a cross-section along the line A-A of FIG. 1 showing a previously known guide system.

FIG. 2 shows a cross section along the line A-A of FIG. 1 with previously known guide systems 10, 12 provided on each side of the escalator 1 in the sloping part of the escalator 1. Section 5, manufactured as a single piece and arranged on the truss 4, has a running surface 5.1 for chain rollers 7 and a running surface 5.2 for step rollers 8. Section 6 of the guide system, made of two parts and arranged on the truss 4, has a running section or part 6.1 for the step rollers 8 and a running section or part 6.2 for the chain rollers 7. Guidance of a side of the step 3 takes place by means of a sliding pin 6.3 that rests against the running section 6.2. Provided for each step 3 is a chain axle 7.2 that imparts movement to the step 3 and that is connected at its ends to chain links 7.1.

Figure 3:
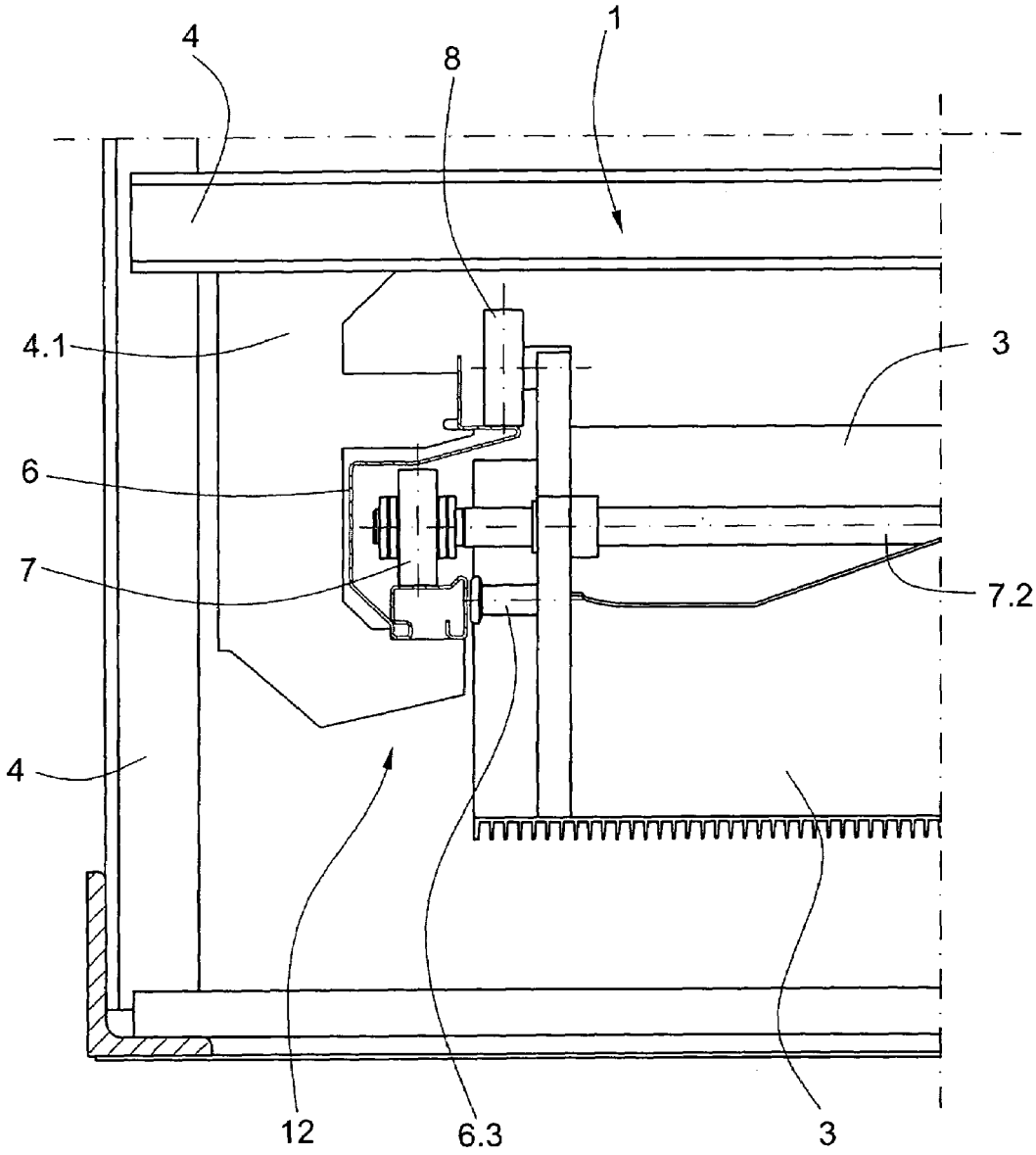
FIG. 3 is an enlarged cross-section view of area B of FIG. 2 with a guide system according to the invention for the return of the escalator steps.

FIG. 3 is a cross-section of area B of FIG. 2 with the section 6 according to the invention for the escalator steps 3 on the return run. The conventional two-piece section 6 of FIG. 2 has been replaced by the single-piece section 6 according to the invention. The single-piece section 6, which is provided on each side of the escalator, is supported by bracket plates 4.1 of the truss 4 and guides the rollers 7, 8 on their return run in the sloping part of the escalator 1. The guide system 10 for the transporting run can be constructed similarly to the return run guide system 12 utilizing the inventive single-piece section 6, according to the invention.

Figure 4:
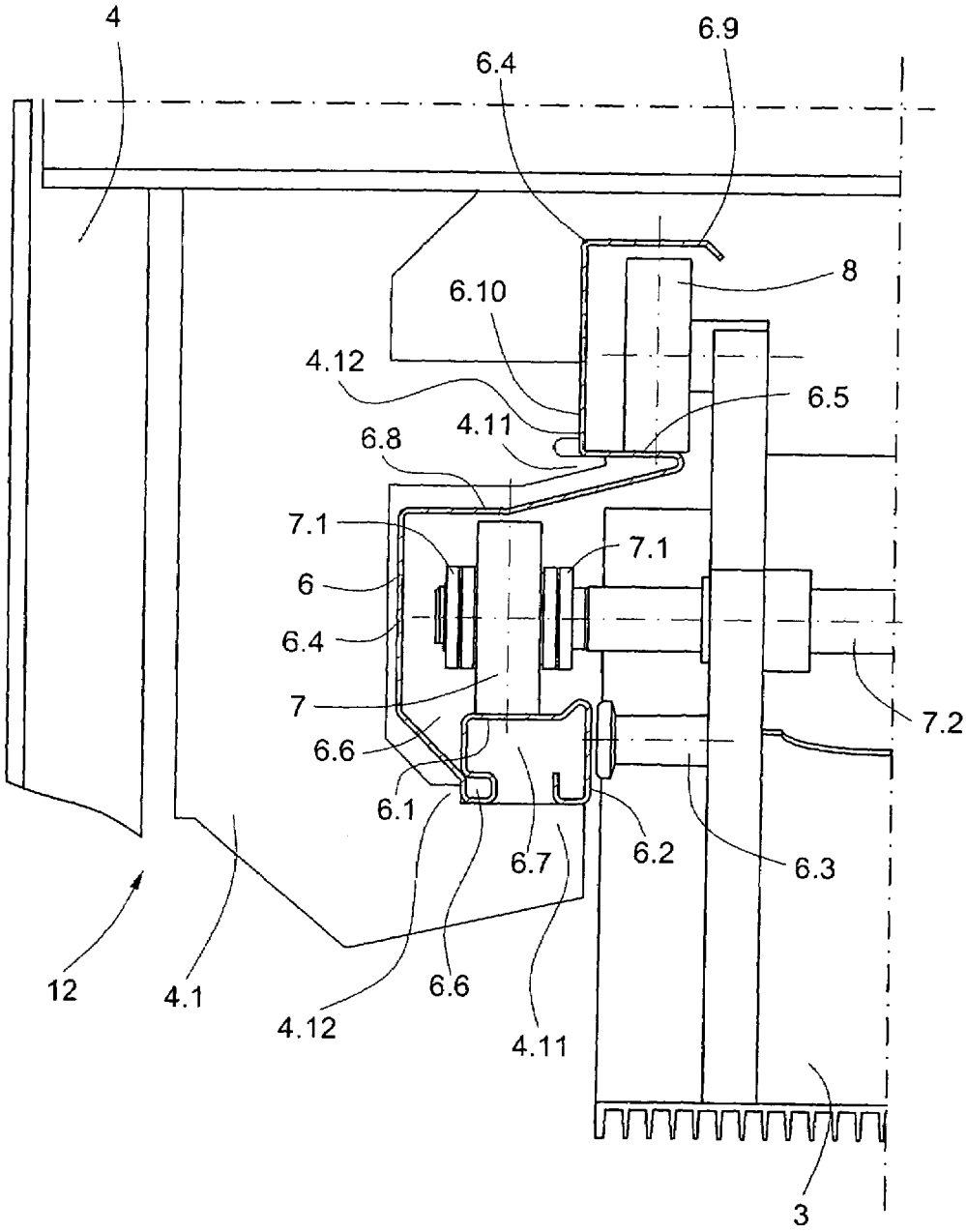
FIG. 4 details the guide system according to the invention.

FIG. 4 shows further details of the section 6 according to the invention as shown in FIG. 3. The single-piece section 6 has several areas with different functions:

A running surface 6.1 serves to guide the running of the chain rollers 7. To guide the sides of the steps 3, the sliding pin 6.3 rests on a side surface 6.2. Should the chain rollers 7 leave the running surface 6.1, a first counter-surface 6.8 serves as a counter-guide and prevents the chain links 7.1 from being pushed together. Should the step rollers 8 leave the running surface 6.5, a second counter-surface 6.9 serves as counter-guide. The single-piece section 6 can also be executed with the first counter-surface 6.8 and without the second counter-surface 6.9. The counter-surfaces 6.8, 6.9 are parts of protective encapsulations 6.4. By means of the encapsulations 6.4, the step rollers 8, the chain rollers 7, the chain links 7.1, and the running surfaces 6.1, 6.5 are protected from dirt, dust, water, snow, salt, objects, etc. For run guidance of the step rollers 8, a running surface 6.5 is provided. An oil collecting channel 6.6 prevents dripping of lubricating oil or lubricating grease. The section 6 rests on bracket plate projections 4.11 and is removably fastened at least one fastening support 6.7 or fastening face 6.10 by means of screws or clips to the bracket plate 4.1.

The single-piece section 6 is simple and efficient to install and can be laterally exactly positioned by stops 4.12 of the bracket plate projections 4.11 and thereby accurately adapted and dimensioned to the truss 4.

The single-piece section 6 according to the invention is preferably made and cold-formed from an endless strip of steel sheet, as a result of which the required accuracy of the running surfaces 6.1, 6.5 is assured. With a deformation angle of 90°, for example, the accuracy is +0.50.

With a single-piece section 6, a substantial saving of time and effort for installation and manufacture as well as a considerable cost saving is attainable.

The height of bracket plates 4.1 that are used can be significantly shortened which, due to their large number, results in a reduced weight of the truss and an additional cost advantage. The distances between the chain roller axle and the step roller axle in shown FIGS. 2 and 4 shows the shortening of the bracket plates that can be accomplished in the present invention, which is approximately 100-150 mm. The truss 4 can also be constructed with a correspondingly lesser height.

We claim:

1. A guide system for step rollers and chain rollers of steps of an escalator, comprising a single-piece section having a first area for guiding the run of the step rollers and a second area for guiding the run of the chain rollers, the first and second areas being located in different planes, at least one area for fastening the section onto a truss, at least one area for protecting the step and chain rollers and their run guides having a first upwardly extending portion located proximate an outwardly-lying side of the step rollers and a second upwardly extending portion located proximate an outwardly-lying side of the chain rollers, and at least one area for counter-guiding at least one of the step and chain rollers.

2. The guide system according to claim 1, further comprising bracket plates supporting the area for guiding the run of the chain rollers and the area for either guiding the run of the step rollers or pallet rollers.

3. The guide system according to claim 2, wherein at least one of the first and second upwardly extending portions includes a stop surface against which a portion of the bracket plates bears to align the guide system with respect to the rollers.

4. The guide system according to claim 1 or 2, characterized in that the area for protecting the rollers is in the form of an encapsulation that surrounds and protects the rollers.

5. The guide system according to claim 4, characterized in that at least one counter-surface serving as a counter-guide forms part of the encapsulation.

6. The guide system according to claim 1 or 2, characterized in that the section has an area for guiding sides of the rollers.

7. The guide system according to claim 1 or 2, characterized in that the section is made from a continuous steel plate by cold forming and with a deformation angle of 90° at an accuracy of ±0.5°.

8. The guide system according to claim 1 or 2, characterized in that the section has at least one area for collecting lubricant.

9. A method of installation of a guide system according to claim 1 or 2, comprising the steps of placing the section on at least one bracket plate projection and removably fastening the section to at least one fastening support or face of the bracket plate by screws or clips.

10. The method of claim 9 further comprising the step of aligning a stop surface on an upwardly extending portion of the section against a portion of the bracket plate to horizontally align the guide system upon the bracket plate projection with respect to the rollers.

* * * * *